US006115575A

United States Patent [19]

Kinoshita et al.

[11] Patent Number: 6,115,575

[45] Date of Patent: Sep. 5, 2000

[54] DEVELOPING APPARATUS

[75] Inventors: Masahide Kinoshita, Shizuoka-ken; Kazuhisa Kemmochi, Mishima; Kenji Fujishima, Yokohama; Yasunari Watanabe, Shizuoka-ken, all of Japan

[73] Assignee: Canon Kabushiki Kaisha, Tokyo, Japan

[21] Appl. No.: 09/371,903

[22] Filed: Aug. 11, 1999

[30] Foreign Application Priority Data

Aug. 14, 1998 [JP] Japan ..... 10-244447

[51] Int. Cl.[7] ..... G03G 15/08

[52] U.S. Cl. ..... 399/286; 430/101

[58] Field of Search ..... 399/284, 286, 399/279; 428/35.8; 430/101, 106.6, 120, 122; 492/48, 53

[56] References Cited

U.S. PATENT DOCUMENTS

| | | | |
|---|---|---|---|
| 4,908,665 | 3/1990 | Takeda et al. | 430/101 |
| 5,187,526 | 2/1993 | Zaretsky | 355/273 |
| 5,741,616 | 4/1998 | Hirano et al. | 430/101 |

FOREIGN PATENT DOCUMENTS

| | | |
|---|---|---|
| 36-10231 | 7/1936 | Japan . |
| 56-13945 | 2/1981 | Japan . |
| 59-053856 | 3/1984 | Japan . |
| 59-061842 | 4/1984 | Japan . |
| 59-125739 | 7/1984 | Japan . |
| 3-200986 | 9/1991 | Japan . |
| 7-209552 | 9/1995 | Japan . |
| 8-185041 | 7/1996 | Japan . |

OTHER PUBLICATIONS

Polymer Handbook, Second Edition, Brandrup, et al., "The Glass Transition Temperatures of Polymers", by W.A. Lee, et al., pp. III–139 through III–192.

*Primary Examiner*—Arthur T. Grimley
*Assistant Examiner*—Hoan Tran
*Attorney, Agent, or Firm*—Fitzpatrick, Cella, Harper & Scinto

[57] ABSTRACT

A developing apparatus includes a developer container for containing a developer; a developer bearing member for bearing the developer contained in the developer container, the developer bearing member having a surface layer containing substantially spherical particles, wherein a relation between a weight-average particle diameter r (μm) of a toner in the developer and a volume-average particle diameter R (μm) of the spherical particles satisfies an equation $0.5 \leqq R/r \leqq 1.9$.

14 Claims, 4 Drawing Sheets

DEVELOPING APPARATUS

BACKGROUND OF THE INVENTION

1. Field of the Invention

The present invention relates to a developing apparatus which is installed in a color image forming apparatus using an electrophotographic process or the like and which is used to visualize an electrostatic latent image formed on an image bearing member.

2. Related Background Art

In a full-color image forming apparatus, for example, a copying machine, there are usually utilized a method which comprises using four photosensitive drums, developing an electrostatic latent image formed on each photosensitive drum with cyan, magenta, yellow and black toners, conveying a transfer material to the photosensitive drum by a transfer belt (a belt-shaped transfer member), and then transferring each color toner image obtained by the development to the transfer material to form the full-color image thereon; and another method which comprises winding a transfer material around a surface of a transfer drum (a transfer material holding member) by an electrostatic attractive force or a mechanical function such as a gripper, conveying the transfer material to one photosensitive drum opposed to the transfer drum, transferring a toner image formed on the photosensitive drum to the transfer material, and then repeating the steps of the formation and the transfer of the toner image for four colors, thereby obtaining the full-color image.

In recent years, the development of a technique is increasingly demanded where in the image forming apparatus, a small-size paper such as a cardboard, a card and a postal card is applicable as the full-color transfer material, in addition to an ordinary paper and a film for an overhead projector (OHP).

For the image forming apparatus in which the transfer belt is used to convey the transfer material, since the transfer material is conveyed in a plane state, images can be formed on various transfer materials and an application range is extensive. However, a plurality of toner images need to be correctly superposed in a predetermined position of the transfer material, and even a slight difference in registration deteriorates an image quality. To enhance a registration precision, a conveying mechanism of the transfer material is complicated, and the number of components is disadvantageously increased.

On the other hand, for the image forming apparatus in which the transfer material is wound around the surface of the transfer drum by adsorption, and the like, and is conveyed, when a cardboard large in basic weight is used, because of a rigidity of the transfer material, a trailing end of the transfer material causes a failure in a tight fit with the surface of the transfer drum, and as a result, a defective image caused by the transfer is easily produced. Even in the small-size paper, the defective image may be produced by the same cause.

Therefore, various image forming methods using intermediate transfer members have been proposed. For example, a full-color image forming apparatus using an intermediate transfer drum, that is, a drum-shaped intermediate transfer member is described in U.S. Pat. No. 5,187,526. However, in the description of the patent, shapes and constitutions of toner particles are not concretely mentioned. In Japanese Patent Application Laid-Open No.59-125739 described is a method in which a toner image formed with a toner with an average particle diameter of 10 $\mu$m or less is transferred to an intermediate transfer member, and the toner image on the intermediate transfer member is transferred to a transfer material. As one toner manufacturing method, a direct manufacturing method by a suspending polymerizing method is described. For a transfer in an image forming process of the publication, a pressure transfer or a sticky transfer is performed, which has a problem that the surface of the intermediate transfer member is easily contaminated by the transfer of a multiplicity of materials.

In the image forming apparatus which uses the intermediate transfer member, after the toner image is once transferred to the intermediate transfer member from an electrostatic latent image bearing member such as the photosensitive drum, the image is again transferred onto the transfer material from the intermediate transfer member. Therefore, a toner transfer efficiency needs to be enhanced more than before.

To solve the problem, the present applicant has proposed an image forming apparatus which uses an intermediate transfer member as shown in FIG. 4 (Japanese Patent Application Laid-Open No. 7-209552).

In FIG. 4, numeral 101 denotes a photosensitive drum as a first image bearing member, the photosensitive drum 101 is rotatively driven in an arrow direction in the drawing, and in the process of rotation the surface of the photosensitive drum 101 is uniformly and negatively charged by charging means 102. Subsequently, exposure scanning is performed by exposure means 103 ON/OFF controlled in accordance with first image information, and a first-color electrostatic latent image is formed on the surface of the photosensitive drum 101. The latent image is developed by a first-color negatively charged developer included by a first developing apparatus 104*a,* and visualized as a first-color toner image. Here, toner for use is manufactured by the suspending polymerizing method, contains a low softening point material, and has a shape coefficient SF1 of 100 to 150.

The first-color toner image visualized as described above is electrostatically transferred on the surface of an intermediate transfer member 105 rotatively driven as a second image bearing member, in a position opposite to the intermediate transfer member 105 (a primary transfer). The process is reiterated a plurality of times, and second-color, third-color, and fourth-color latent images serially formed on the surface of the photosensitive drum 101 are respectively developed with developers different in color by second, third, and fourth developing apparatuses 104*b,* 104*c,* 104*d* including the respective developers. By transferring the obtained toner images onto the intermediate transfer member 105, a color image in which the four-color toner images are superposed on top of each other is formed on the intermediate transfer member 105.

The color images on the intermediate transfer member 105 are electrostatically transferred in unison onto a transfer material 107 which is conveyed to a nip of a transfer roller 106 rotating in contact with the intermediate transfer member 105 (a secondary transfer). The transfer material 107 with the color images transferred thereon is conveyed to a fixing device 111, where the color images are heated and fixed to the transfer material 107.

Primary transfer residual toner remaining on the surface of the photosensitive drum 101 during the primary transfer, and secondary transfer residual toner remaining on the surface of the intermediate transfer member 105 during the secondary transfer are removed from the surfaces of the photosensitive drum 101 and the intermediate transfer member 105 by cleaning means 109, 110, respectively.

In the above-described proposed image forming apparatus, by using as the toner a substantially spherical toner (a polymerized toner) manufactured by the polymerizing method and having the shape coefficient SF1 of 100 to 150, as compared with non-fixed shape toner (a crushed toner) manufactured by a conventional crushing method, the transfer efficiency can remarkably be enhanced. Even if the use of the intermediate transfer member results in two transfer processes, a color image sufficiently excellent in respect of the transfer can be reproduced.

Moreover, the polymerized toner contains a low softening point material such as paraffin wax, and the like. Without applying a large amount of silicone oil, or the like to the fixing roller of the fixing device 111, the occurrence of offset can be prevented. Also in this respect an excellent full-color image can be obtained.

A developing method of the developing apparatus 104 (104*a* to 104*d*) is not particularly limited. Generally examples of the developing method for use in the color image forming apparatus include a non-magnetic monocomponent method and a non-magnetic two-component method. In the latter non-magnetic two-component method, since a two-component developer with toner and carrier mixed therein is used, with consumption of the toner the mixture ratio needs to be adjusted, which raises a problem that the apparatus constitution is complicated and enlarged.

Therefore, in recent years, the former non-magnetic monocomponent method has been frequently used, and as a developing apparatus suitable for the developing method, a constitution as shown in FIG. 5 is prevalently used.

In FIG. 5, numeral 115 denotes a developer container, 112 denotes a developing sleeve as a developer bearing member provided in an opening portion of the developer container 115, the developing sleeve 112 is rotatively driven in an arrow direction in the drawing. A developing blade 113 and a toner supplying and collecting roller 114 abut against the surface of the sleeve.

The developing blade 113 as a toner regulating member is constituted by bonding an elastic member 113*b* of urethane rubber, and the like on the side of the surface of a support member 113*a* formed of phosphor bronze or another elastic material opposite to the developing sleeve 112, elastically abuts against the surface of the developing sleeve 112, and has functions of forming a thin layer of toner on the surface of the developing sleeve 112 and applying a triboelectric charge to the toner.

The toner supplying and collecting roller 114 is constituted by coating an outer peripheral surface of a core metal 114*a* formed of SUS, and the like with an elastic member 114*b* of urethane foam, and the like, and has functions of supplying non-magnetic toner contained in the developer container 115 to the surface of the developing sleeve 112 and of scraping off from the surface of the developing sleeve 112 a toner returning to the developer container 115 without contributing to development in a developing section opposed to the photosensitive drum 101.

The developing apparatus constituted as described above is excellent for the non-magnetic toner of the conventional crushing method, and can preferably form the thin layer of the non-magnetic toner sufficiently provided with the triboelectric charge on the surface of the developing sleeve 112.

On the other hand, when the above-described developing apparatus is applied to the above-described polymerized toner which is a toner formed by the polymerizing method, having the shape coefficient SF1 of 100 to 150, having a substantially spherical shape, and containing the low-softening point material, the following disadvantages are caused.

Generally a powder smaller in particle diameter than the toner is externally applied to the toner for the main purpose of enhancing and stabilizing the triboelectric charge. Even in the polymerized toner, for example, a fine powder of silica, or the like is added as an external application agent, and the external application agent adheres to surfaces of individual toner particles in a covering manner.

However, since the polymerized toner is spherical, the adhering force of the external application agent to the toner tends to be weaker as compared with the crushed toner. The external application agent present on the surface of the toner on the developing sleeve 112 is gradually liberated from the toner as the developing sleeve 112 continues to rotate. Therefore, when the toner not having contributed to the development is removed by the toner supplying and collecting roller 114, the toner can be removed, but the liberated external application agent is insufficiently removed, and remains on the surface of the developing sleeve 112.

If the adhesion of the external application agent to the surface of the developing sleeve 112 continuously occurs, a film of the external application agent is shortly formed on the surface of the developing sleeve 112. Although in the nip portion between the developing sleeve 112 and the developing blade 113 which abuts against the sleeve 112 an electric charge should originally be applied to the toner, this is prevented by the film of the external application agent, and a sufficient charge cannot be applied to the toner. Furthermore, the insufficiently charged toner slips out of the nip portion, and phenomenon so-called dripping of the toner occurs.

In Japanese Patent Application Laid-Open No. 8-185041, it is proposed that on the surface of the developing sleeve 112 a coating layer containing a main component of resin, and carbon, graphite and another conductive fine powder or a solid lubricant dispersed in the component be formed to prevent the external application agent from adhering to the surface of the developing sleeve 112.

Additionally, to attain a high image quality of a recent image forming apparatus of 600 dpi, 1200 dpi, or the like, it is intended to obtain small particle diameters or fine particles of the toner. In order to faithfully reproduce the latent image on the photosensitive drum and obtain a high resolution, a fine toner whose weight-average particle diameter is in the range of about 4 to 7 $\mu$m needs to be used. Moreover, the developing apparatus is constantly requested to have a reduced running cost, a high quality and a high reliability, and also have a high durability and an extended life.

If the fine-particle toner is used, and in the developing apparatus, the developing operation is repeated particularly under a low-humid environment, it becomes difficult to obtain a sufficient image density.

Specifically, the charge amount of the toner with which the developing sleeve 112 is coated becomes excessively high by contact with the developing sleeve, and the toner has difficulty in moving to the latent image on the photosensitive drum 101 by a reflection force with the developing sleeve surface. Moreover, since a high charge amount of toner is present in a lower layer of the toner layer on the surface of the developing sleeve 112, the toner present in a top layer thereof cannot have an opportunity to contact the developing sleeve surface, and it becomes difficult to obtain the electric charge. As a result, since either upper layer toner or lower layer toner on the developing sleeve cannot easily move to the latent image, the image density is lowered, and the upper layer toner is further easily scattered.

The phenomenon tends to be promoted because the particles become finer and a surface area per unit weight of the toner is accordingly enlarged.

As a countermeasure, a method of appropriately roughening a surface roughness of the developing sleeve 112 is considered. Thereby, a conveying property of the toner by the developing sleeve is enhanced, while the rolling or switching of the toner under the pressure contact of the developing blade 113 on the developing sleeve surface is promoted. As a result, on the developing sleeve a toner layer uniformly having an appropriate electric charge amount can be formed.

The roughening of the surface roughness of the developing sleeve 112 can be realized by increasing an addition ratio of carbon or graphite in the resin forming the coating layer, but first the method has a problem in respect of durability because the coating layer becomes brittle and is easily worn. Particularly in the non-magnetic monocomponent developing apparatus, since the developing blade 113 and the toner supplying and collecting roller 114 originally pressure-contact the surface of the developing sleeve 112, wear resistance of the developing sleeve 112 needs to be enhanced.

Secondly, it is difficult to control the surface roughness of the developing sleeve 112 by the coating layer to which the fine particles of non-uniform shapes are added, and the shape of the developing sleeve surface unfavorably becomes non-uniform.

As shown in Japanese Patent Application Laid-Open No. 3-200986, it is proposed that a conductive coating layer, in which in addition to a solid lubricant or carbon and other conductive fine particles, spherical particles are dispersed in resin, be formed on the surface of the developing sleeve 112.

The proposed method has merits that the shape of the surface of the developing sleeve 112 is uniformed, the conveying property and triboelectric charging property of the toner are uniformed and that the wear resistance of the developing sleeve surface can be enhanced. However, even when this method is used, it is difficult to stably and excellently form the toner layer of the fine-particle polymerized toner on the developing sleeve.

Therefore, when the fine-particle polymerized toner is applied to the developing apparatus, influencing factors having influence on a developing property, and the like, such as the particle diameter of the polymerized toner, the surface roughness of the developing sleeve, the particle diameter of the spherical particle to be added to the coating layer of the developing sleeve surface, and the like need to be considered, and it has been desired that these factors be appropriately defined.

SUMMARY OF THE INVENTION

An object of the present invention is to provide a developing apparatus which makes possible formation of a high-quality image.

Another object of the present invention is to provide a developing apparatus which makes possible formation of an image having no uneven vertical line without deteriorating a durable density.

Further object of the present invention is to provide a developing apparatus in which even when in a non-magnetic toner of a monocomponent developer a fine-particle polymerized toner containing a low softening point material is used for the purpose of forming a high-quality color image, an excellent toner thin layer can be stably formed on a developing sleeve, and used for development.

Still further object of the present invention is to provide a developing apparatus comprising a developer container containing a developer; a developer bearing member bearing the developer contained in the developer container, the developer bearing member having a surface layer containing substantially spherical particles, wherein a relation between a weight-average particle diameter r ($\mu$m) of a toner in the developer and a volume-average particle diameter R ($\mu$m) of the spherical particles satisfies the following expression:

$$0.5 \leqq R/r \leqq 1.9.$$

Objects of the present invention other than those described above and characteristics of the present invention will further be clear by reading the following detailed description with reference to the accompanying drawings.

DETAILED DESCRIPTION OF THE PREFERRED EMBODIMENTS

Figure 1:
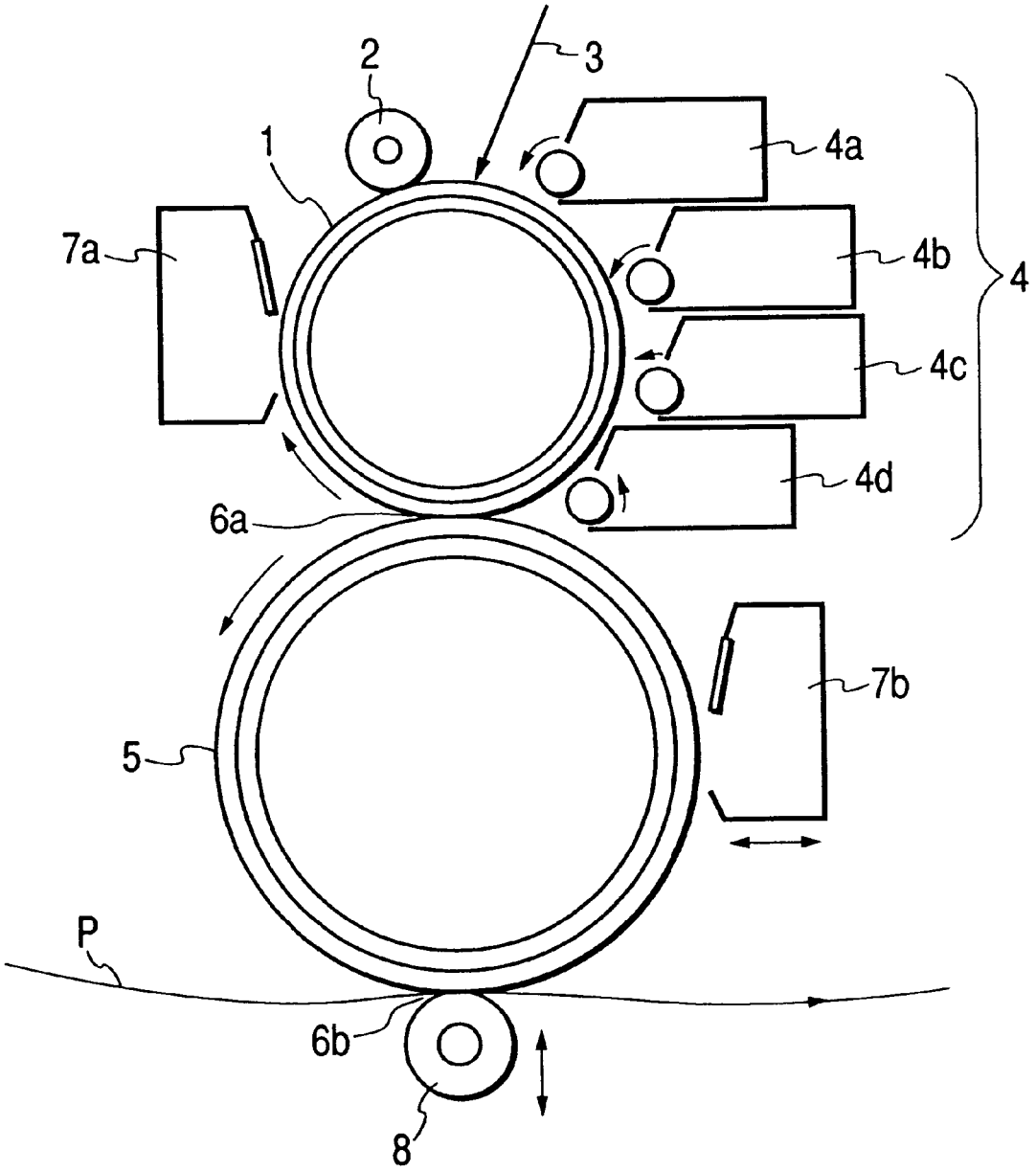
FIG. 1 is a diagrammatic view showing an image forming apparatus in which a developing apparatus of the present embodiment is installed.

FIG. 1 is a schematic view showing a main section of an image forming apparatus provided with a developing apparatus of the present embodiment.

In FIG. 1, numeral 1 denotes a photosensitive drum as an image bearing member, and the photosensitive drum 1 is constituted by forming a photosensitive layer of OPC, amorphous Se, amorphous Si, and the like on an outer peripheral surface of a base member formed of a cylinder of aluminum, nickel or another metal. The photosensitive drum 1 is rotatively driven in an arrow direction in the drawing at a predetermined peripheral speed, and in the process of rotation the surface of the drum is uniformly charged to a dark section potential (VD) of −700V by a charging roller 2 which is a charging apparatus. Subsequently, scanning exposure is applied to the surface of the photosensitive drum 1 by a laser beam 3 ON/OFF controlled in accordance with first-color image information, and a first-color electrostatic latent image is formed on the surface of the photosensitive drum 1 at a bright section potential (VL) of −100 V.

The latent image formed in this manner is developed by a developing apparatus 4, and visualized as a toner image. Specifically, the developing apparatus 4 for four colors is provided with a first developing apparatus 4*a* containing a first-color yellow toner, a second developing apparatus 4*b* containing a second-color magenta toner, a third developing apparatus 4*c* containing a third-color cyan toner, and a fourth developing apparatus 4*d* containing a fourth-color black toner. The latent image is developed by the first developing apparatus 4*a,* and a yellow toner image is formed as a first color. As a developing method, image exposure and reversal development are often combined for use.

By applying a voltage having a polarity reverse to a charge polarity of a toner to the intermediate transfer member 5 as a second image bearing member from a high-voltage power supply (not shown), the first-color yellow toner image is electrostatically transferred to the surface of an intermediate transfer member 5 in a first transfer position 6*a* in contact with the photosensitive drum 1 (primary transfer). The intermediate transfer member 5 has a peripheral length slightly longer than a length of a transfer material, is placed in pressure contact with the photosensitive drum 1 with a predetermined pressure, and is rotatively driven at a peripheral speed substantially equal to that of the photosensitive drum 1 in an arrow direction of the drawing. Primary transfer residual toner remaining on the surface of the photosensitive drum 1 after the primary transfer is completed is removed by a cleaning apparatus 7*a*.

The process is further reiterated three times, and second-color, third-color, and fourth-color latent images serially formed on the surface of the photosensitive drum 1 are developed by the second, third, and fourth developing apparatuses 4*b,* 4*c,* 4*d,* using magenta, cyan and black toners, respectively. By transferring obtained toner images onto the intermediate transfer member 5, a color image in which the four-color toner images of yellow, magenta, cyan and black are superposed on top of each other is formed on the intermediate transfer member 5.

Thereafter, by applying the voltage having the polarity opposite to the charge polarity of the toner to a transfer roller 6*b* from the high-voltage power supply (not shown), the color images on the intermediate transfer member 5 are transferred in unison to the surface of a transfer material P conveyed at a predetermined timing in a second transfer position 6*b* in contact with the intermediate transfer member 5 (a secondary transfer). During the secondary transfer, a transfer roller 8 previously in a detached state is pressure-contacted to the surface of the intermediate transfer member 5 with a predetermined pressure and placed in a contact state. The transfer roller 8 is rotated by driven rotation or by driving rotation.

The transfer material P with the color images transferred thereto is conveyed to a fixing apparatus (not shown), in which the color image is heated and fixed on the transfer material P to form a permanent image, and is then discharged to the outside of the image forming apparatus. When the secondary transfer is completed, secondary transfer residual toner remaining on the surface of the intermediate transfer member 5 is removed from the surface of the intermediate transfer member 5 by a cleaning apparatus 7*b* which is placed in an operating state at a predetermined timing relative to the intermediate transfer member 5.

Figure 2:
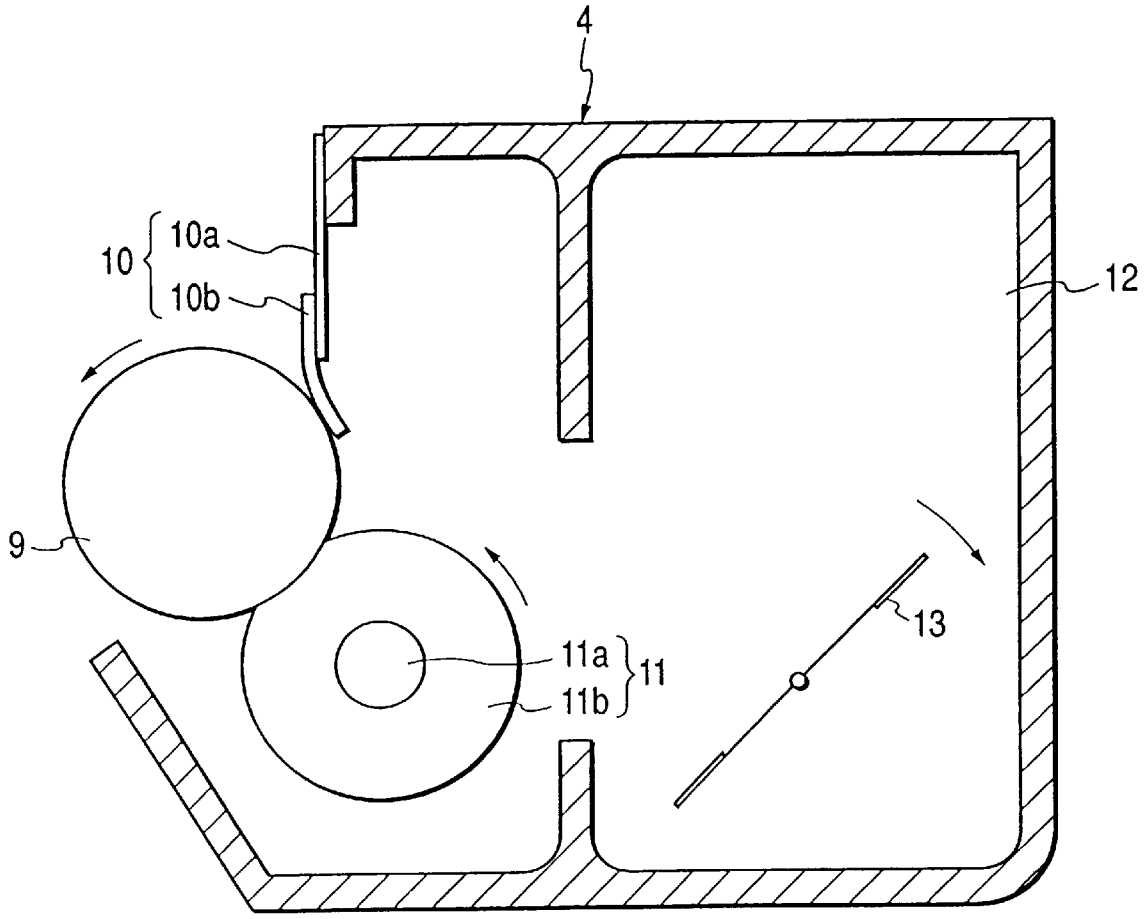
FIG. 2 is a diagrammatic sectional view showing one embodiment of the developing apparatus which is installed in the image forming apparatus of FIG. 1.

Details of the constitution of the developing apparatus 4 (developing apparatuses 4*a* to 4*d*) according to the present embodiment will be described with reference to FIG. 2.

The developing apparatus 4 is constituted by providing a developer container 12 containing a non-magnetic toner with a developing sleeve 9, a developing blade 10, a toner supplying and collecting roller 11 and an agitating blade 13.

Figure 3:
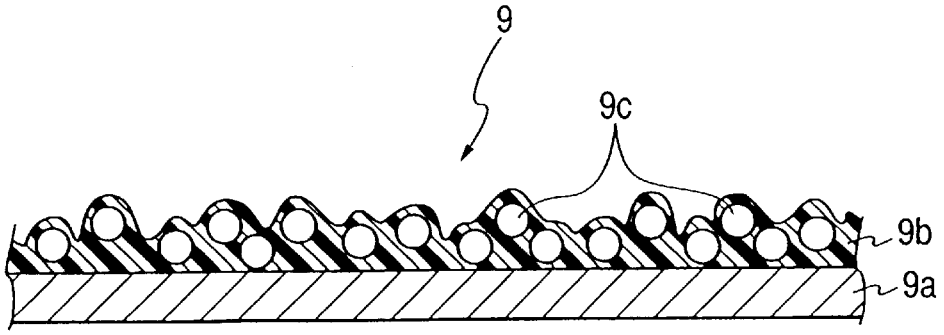
FIG. 3 is a sectional view showing a surface portion of a developing sleeve installed in the developing apparatus of FIG. 2.
Figure 4:
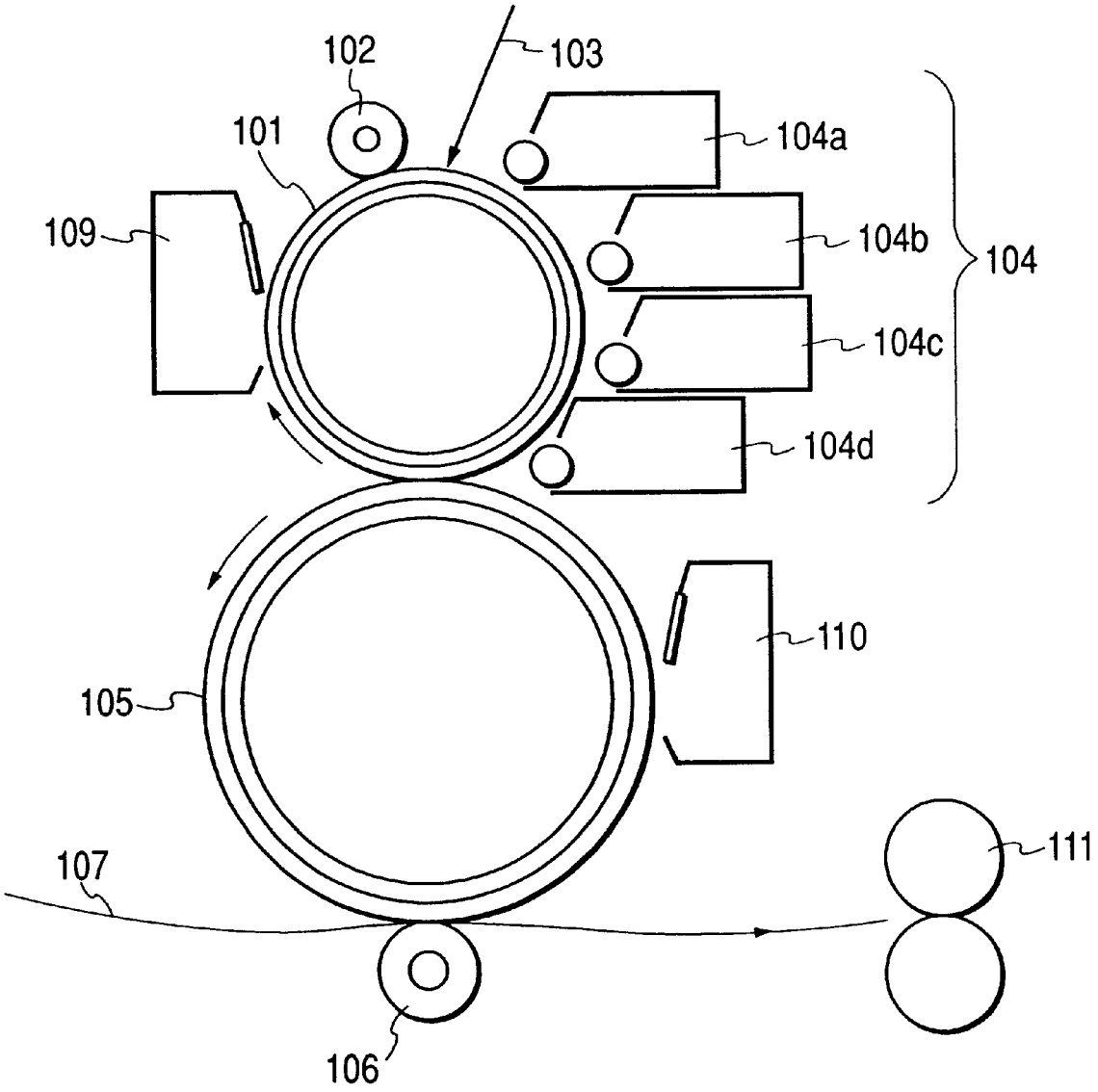
FIG. 4 is a diagrammatic view showing an image forming apparatus in which a developing apparatus is installed.
Figure 5:
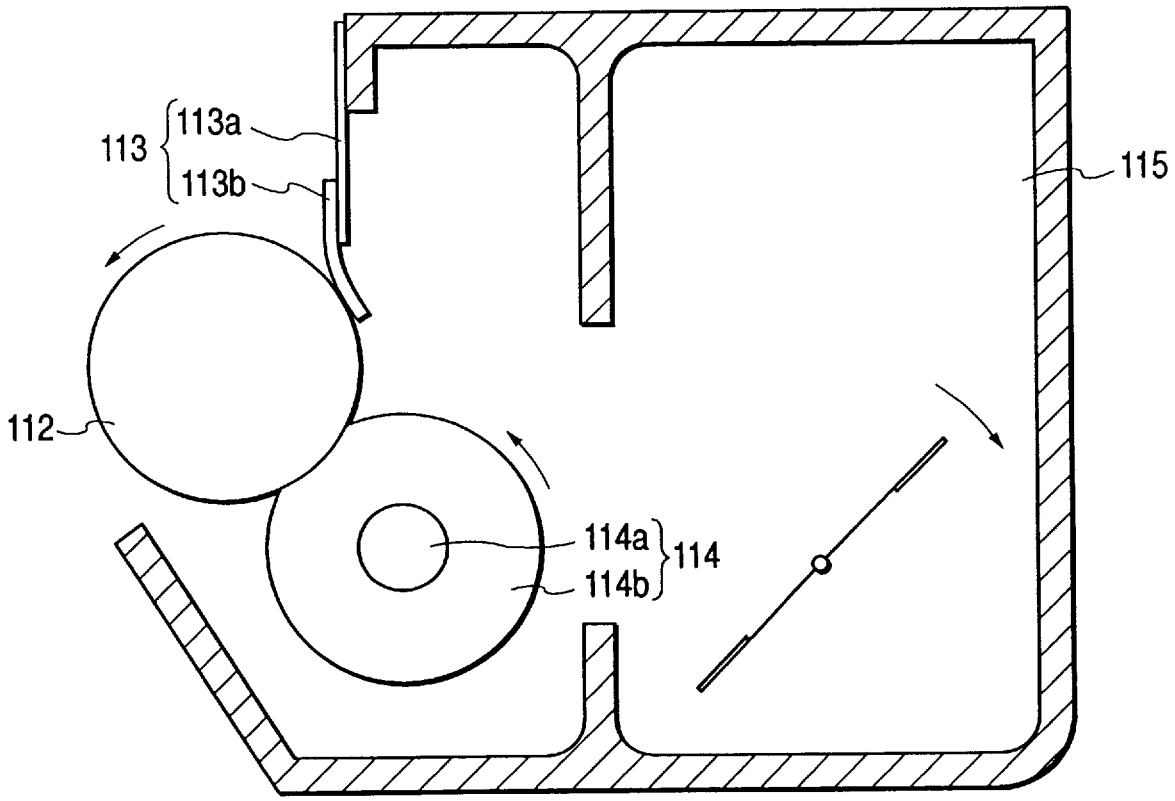
FIG. 5 is a diagrammatic sectional view showing the developing apparatus installed in the image forming apparatus of FIG. 4.

The developing sleeve 9 is usually constituted of a cylindrical member of aluminum, an alloy thereof, stainless steel, or another metal, but the metal is not particularly limited as long as it can easily be formed into the cylindrical member. In the present invention, as shown in FIG. 3, an aluminum cylinder with an outer diameter of 16 mm is used as a sleeve base member 9*a,* and a coating layer 9*b* is formed on the surface of the base member to form the developing sleeve 9.

Additionally, to the developing sleeve 9 an alternate voltage in which an alternating-current voltage is superimposed to a direct-current voltage is applied.

A copolymer is used in a binder resin for use in the coating layer 9*b* on the surface of the developing sleeve 9, and the copolymer preferably contains a main component of methyl methacrylate. When the methyl methacrylate is used as a polymer, it becomes superior in mechanical strength. When the methyl methacrylate is used as a copolymer containing a nitrogen-containing vinyl monomer, a property of applying the triboelectric charge to the toner is enhanced, and the layer becomes more preferable as the coating layer of the developing sleeve 9.

Typical examples of the nitrogen-containing vinyl monomer include p-dimethylaminostyrene, dimethylaminomethyl acrylate, dimethylaminoethyl acrylate, dimethylaminopropyl acrylate, diethylaminomethyl acrylate, diethylaminoethyl acrylate, dimethylaminomethyl methacrylate, dimethylaminoethyl methacrylate, and the like.

Furthermore, there are N-vinylimidazole, N-vinylcarbazole, N-vinylpyrol, and other nitrogen-containing heterocyclic N-vinyl compound.

A ratio of the methyl methacrylate monomer and the nitrogen-containing vinyl monomer is in the range of 999:1 to 8:2 in terms of a mol ratio. When the ratio exceeds 999:1, no enhancement is recognized in the property of applying the triboelectric charge which is an adding effect of the nitrogen-containing vinyl monomer. Moreover, when the ratio lowers below 8:2, a glass-transition temperature Tg of the resin lowers, and the coating layer formed of the resin unfavorably becomes unstable. A thickness of the coating layer is preferably in the range of 4 to 2 $\mu$m to obtain a uniform film thickness.

According to the present embodiment, spherical particles 9*c* are blended in the coating layer 9*b* on the surface of the developing sleeve 9. When the spherical particles are present in the coating layer 9*b* on the surface of the developing sleeve 9, the surface of the developing sleeve 9 is provided with a uniform surface roughness. Additionally, when the coating layer surface is provided with certain degrees of convex portions, toner fusing or toner contamination is effectively prevented from easily occurring with pressing forces by the developing blade 10 and the toner supplying and collecting roller 11 onto the coating layer surface.

In the present embodiment, a true density of the spherical particle is set to 3 g/cm$^3$ or less. When the true density exceeds 3 g/cm$^3$, dispersing properties of the spherical particles in the coating layer become insufficient, and it becomes difficult to apply the uniform roughness to the coating layer surface.

As the spherical particles, for example, spherical resin particles, spherical metal oxide particles, spherical carbide particles, and other known particles can be used.

Examples of the spherical resin particles include polyacrylate, polymethacrylate and other acrylic resin particles, nylon and other polyamide resin particles, polyethylene, polypropylene and other polyolefin resin particles, silicone resin particles, and the like. To the spherical resin particles, a metal oxide such as $SiO_2$, $SrTiO_3$, and MgO, a nitride such as SiN, a carbide such as SiC or another inorganic fine powder may be stuck or fixed for use. The inorganic fine powder may be treated by a coupling agent, and used for the spherical particles for the purpose of enhancing the adherence of the spherical particles with the binder resin and providing the spherical particles with hydrophobic nature.

The spherical particles can be provided with conductivity, whereby electric charges are not easily accumulated on the spherical particle surfaces, the adhesion of the toner to the developing sleeve surface is alleviated, and the property of applying the electric charge to the toner can be enhanced.

The conductive spherical particles can be obtained, for example, in the following method, but the method is not limited. In one method, phenol resin, naphthalene resin, furan resin, xylene resin or other resin spherical particles, or methocarbon micro-beads are calcined, carbonized and further graphitized, whereby low-density and well-conductive spherical carbon particles can be obtained.

In another method, after the spherical resin particles forming core particles are mechanically mixed with conductive fine particles at an appropriate blending ratio, and after the conductive fine particles adhere to peripheries of the resin particles, surfaces of the resin particles are softened with a local temperature rise by a mechanical impact force, and the conductive fine particles are formed into a film on the resin particle surfaces, so that the spherical resin particles with the surfaces subjected to a conductive treatment can be obtained. As a resin material to form the core particles, a material from which spherical particles small in true density can be obtained is preferable, and for example, PMMA, acryl resin, polybutadiene resin, and the like can be used.

The adding amount of the spherical particles relative to the binder resin of the coating layer is in the range 2 to 120 parts by weight relative to 100 parts by weight of the binder resin to produce particularly preferable results. When the adding amount of the spherical particles is less than 2 parts by weight, the adding effect of the spherical particles is small. When the amount exceeds 120 parts by weight, conversely the coating layer becomes brittle, and the wear resistance of the coating layer is deteriorated.

According to the present embodiment, the coating layer can be formed of the binder resin and the spherical particles, but if necessary, one or both of a conductive material and a mold releasing material can be contained. Both are preferably contained.

Examples of the conductive material include carbon black, conductive carbon black, carbon fiber and another carbide, a metal powder of aluminum, copper, nickel, silver, and the like, antimony oxide, tin oxide, indium oxide and another metal oxide, and the like. Examples of the mold releasing material include graphite, graphite fluoride, boron nitride, molybdenum disulfide and another solid lubricant.

The adding amount of the conductive material is preferably in the range of 2 to 35 parts by weight relative to 100 parts by weight of the binder resin. When the amount exceeds 40 parts by weight, a deterioration of coat strength of the coating layer, and a decrease of charging amount of the toner are caused. When the amount lowers below 2 parts by weight, by charge-up of the coating layer, the electric charge cannot effectively be applied to the toner.

The adding amount of the solid lubricant is in the range of 10 to 120 parts by weight relative to 100 parts by weight of the binder resin to produce particularly preferable results. When the adding amount of the solid lubricant exceeds 120 parts by weight, the deterioration of coat strength of the coating layer and the decrease of the charging amount of the toner are recognized. The amount of less than 10 parts by weight provides no adding effect, and the toner contamination of the developing sleeve surface is easily caused.

To form the coating layer on the surface of the developing sleeve 9, a coating liquid is prepared to contain the binder resin and the spherical particles and to further contain one or both of the conductive material and the mold releasing material as required, the coating liquid is applied to the surface of the developing sleeve 9 by spraying, dipping or another known method, and drying is performed.

In the present embodiment, as described above, as the base member 9*a* of the developing sleeve 9, the aluminum cylinder with the outer diameter of 16 mm is used, and the coating layer 9*b* is formed on the base member to form the developing sleeve 9. The developing sleeve 9 is rotatively driven at a peripheral speed of 90 mm/second in an arrow direction (a forward direction) in which a portion opposed to the photosensitive drum 1 of FIG. 1 is moved in the same direction. As shown in FIG. 2, the developing blade 10 and the toner supplying and collecting roller 11 abut against the surface of the developing sleeve 9.

The developing blade 10 is constituted by providing a 0.1 mm thick phosphor bronze plate 10*a* having a spring elasticity with a 1 mm thick polyamide elastomer layer 10*b* by adhesion or injection molding. By the elasticity of the phosphor bronze plate 10*a* a pressure contact force of the developing blade 10 for the developing sleeve 9 is maintained, and by the polyamide elastomer layer 10*b* the negative-polarity toner is provided with the triboelectric charge property. The polyamide elastomer layer 10*b* abuts against the surface of the developing sleeve 9 with a linear load of about 20 gf/cm. The polyamide elastomer is formed by ester linkage or amide linkage of polyamide and polyether.

A polyamide component is composed of polyamide 6, 6.6, 6.12, 11, 12, 12.12, or a copolyamide obtained from polycondensation of the monomer, and preferably a component obtained by carboxylating a terminal amino group of the polyamide by a dibasic acid, and the like is used.

As the dibasic acid, used is oxalic acid, succinic acid, adipic acid, suberic acid, sebacic acid, dodecanoic diacid or another aliphatic saturated dicarboxylic acid; maleic acid or another aliphatic unsaturated dicarboxylic acid; phthalic acid, terephthalic acid or another aromatic dicarboxylic acid; a polydicarboxylic aid composed of the dibasic acid and ethylene glycol, butanediol, hexanediol, octanediol, decanediol or another diol; or the like.

As the polyether component, used is homopolymerized or copolymerized polyethylene glycol, polypropyrene glycol, polytetramethylene glycol or another polyether diol, polyether diamine whose both terminals are aminated, or the like.

In the embodiment, the developing blade 10 was prepared as follows:

As the polyamide component, 12-nylon (polyamide 12) carboxylated with dodecanoic diacid which is a dibasic acid was used, and this was reacted with polyethylene glycol which is a polyether component, to synthesize a polyamide elastomer. After the synthesis, the polyamide elastomer was dried for a predetermined time, the elastomer was injected into a metal mold provided with the phosphor bronze plate 10*a,* and injection molding was performed at a fusing temperature of 200° C. and a metal mold temperature of 30° C. so that the developing blade 10 in which the phosphor bronze plate 10*a* is provided with the polyamide elastomer layer 10*b* was obtained.

For the toner supplying and collecting roller 11, to effectively supply the toner to the developing sleeve 9 and scrape off the residual toner after development from the developing sleeve 9, a sponge structure or a fur brush structure in which rayon, nylon or another fiber is implanted on a core metal is preferable.

In the embodiment, as the toner supplying and collecting roller 11, a sponge roller provided with a rubber sponge on the core metal and having a diameter of 12 mm was used. The toner supplying and collecting roller 11 of the sponge directly abuts against the developing sleeve 9, and is rotatively driven by driving means (not shown) in a direction (counter direction) in which the developing sleeve 9 and the abutting portion are moved in opposed directions.

The non-magnetic toner of the monocomponent developer for use in the embodiment will be described in detail. In the present invention, a substantially spherical non-magnetic toner is used whose shape coefficient SF1 indicating a degree of the toner particle spherical shape is in the range of 100 to 150, which is one characteristic.

For the toner shape coefficient SF1, the toner particles are observed with a scanning type electronic microscope (FE-SEM, S-800 manufactured by Hitachi, Ltd.), image information concerning 100 toner particle images selected at random are inputted to an image analyzing apparatus (Lusex 3 manufactured by Nicolet Japan Corporation), and the coefficient is calculated from the following equation:

$$SF1=\{(MXLNG)^2/\mathrm{AREA}\}\times(\pi/4)\times(100)$$

(in which MXLNG denotes a toner absolute maximum length, and AREA denotes a toner projected area).

In the present invention, as described above, the toner with the shape coefficient SF1 in the range of 100 to 150 is used. The shape coefficient SF1 is more preferably in the range of 100 to 125, further preferably 100 to 110.

For the toner particle diameter for use in the embodiment, to develop a micro latent image dot in a solid manner for a high image quality, a toner weight-average particle diameter is preferably 10 $\mu$m or less, more preferably in the range of 4 $\mu$to 8 $\mu$m. In the toner particles with the weight-average particle diameter less than 4 $\mu$m, from a decrease of transfer efficiency, there is much residual toner on the photosensitive drum and the intermediate transfer member after transfer. Furthermore, image non-uniformity based on fogging, or defective transfer is easily caused, and the particles is unfavorable for use in the present invention. When the toner weight-average particle diameter exceeds 10 $\mu$m, the fusing of the toner onto the photosensitive drum surface, the intermediate transfer member and another member is easily caused, which is likewise unfavorable.

A toner particle size distribution can be measured by various methods. In the present invention, the measurement was performed using Coulter counter.

For example, as a measuring apparatus Coulter counter TA-II (manufactured by Coulter K.K.) was used, and an interface (manufactured by Nikkaki K.K.) to output a number distribution and a volume distribution, and a personal computer CX-1 (manufactured by Canon) were connected. For an electrolyte, first-class sodium chloride was used to prepare about 1% NaCl aqueous solution. As the 1% NaCl aqueous solution, for example, ISOTON R-II (manufactured by Coulter Scientific Japan) can be used.

To 100 to 150 ml of the above-described electrolyte a surfactant as a dispersant, preferably alkylbenzenesulfuric acid is added by 0.1 to 5 ml, and further a toner of measurement sample is added by 2 to 20 mg. For the electrolyte in which the sample is suspended, dispersing treatment is performed for about one to three minutes with an ultrasonic dispersing unit, and by the Coulter counter TA-II, a 100 $\mu$m aperture is used to measure the particle size distribution of 2 to 40 $\mu$m toner particles on the basis of the number of particles, so that the weight-average particle diameter defined in the embodiment is obtained.

As the low softening point material to be contained in the toner in the embodiment, the material preferably has a softening point of 40 to 150° C. Furthermore, preferable is a compound in which a main maximum peak value in DSC curve measured in conformity with ASTM D3418-8 indicates the range of 40 to 90° C. When the maximum peak value is less than 40° C., a self flocculation power of the low softening point material is weakened, and as a result, resistance to offset at high temperatures is unfavorably weakened. On the other hand, when the maximum peak exceeds 90° C., a fixing temperature is raised, and it becomes difficult to appropriately smoothen a fixed image surface, which is unfavorable in respect of deterioration of mixed color property. Furthermore, when the toner is manufactured by a direct polymerizing method, granulation and polymerization of the toner are performed in an aqueous medium. Therefore, if the temperature of the maximum peak value is high, the low softening point material is deposited mainly during the granulation, which is unfavorable.

In measurement of the maximum peak value temperature of the low softening point material, for example, DSC-7 manufactured by Perkin-Elmer Corp. is used. For temperature correction of an apparatus detecting section, a fusing temperature of indium and zinc is used, and for heat amount correction, a fusing heat of indium is used. For a sample a pan of aluminum is used, an empty pan is set for control, and the measurement is performed at a temperature rising rate of 10° C./minute.

Examples of the low softening point material include paraffin wax, polyolefin wax, Fischer-Tropsch wax, amide wax, higher fatty acid, ester wax and derivatives (for example, graft compounds, block compounds, and the like) of these waxes.

Furthermore, for the toner for use in a full-color copying machine and a printer, color toners need to be sufficiently mixed in the fixing process, and therefore, enhancement of color reproducibility and transparency of OHP image are important. For the color toner, generally as compared with the black toner, it is more preferable to use a sharp melting resin having a low molecular weight.

In the ordinary black toner, in order to enhance a high-temperature offset property during fixing, a molding lubricant is used which is represented by polyethylene wax and polypropylene wax and which is relatively high in crystallizability. However, in the color toner, because of the crystallizability of the molding lubricant, a transparency of OHP toner image is obstructed at the time of output.

Therefore, usually, without adding the molding lubricant as a component constituting the color toner, by uniformly applying silicone oil, and the like to a heating and fixing roller, enhancement of the resistance to offset at high temperatures is intended. However, for the transfer material having the toner image fixed in this manner, since excess silicone oil or the like adheres to the surface, a user unfavorably suffers discomfort during use.

Therefore, as the low softening point material, an ester wax is preferable which fails to obstruct the OHP transparency, has the resistance to offset at high temperatures and which preferably has one or more, preferably two or more long-chain alkyl groups with the number of carbons being ten or more, preferably 18 or more. Particularly an ester wax having one or more long-chain alkyl ester portions with the number of carbons of ten or more is preferable in the present invention.

Moreover, in recent years, a necessity of full-color double-surface images has been increasing. In the case of formation of the double-surface images, for the transfer material with a toner image formed on one surface, when another toner image is next formed on the opposite back surface, the material is again passed through a heating section of a fixing unit. Therefore, the offset property at high temperatures of the toner needs to be sufficiently considered. Also in this respect, the adding of the low softening point material is important for the toner.

The adding amount of the low softening point material is preferably in the range of 5 to 30 wt % relative to the toner. When the adding amount of the low softening point material is less than 5 wt %, the resistance to offset at high temperatures is deteriorated. Furthermore, in the double-surface image formation, when the toner image on the back surface of the transfer material is fixed, the toner image tends to be offset. When the adding amount of the low softening point material exceeds 30 wt %, for example, in toner manufacturing by a crushing method, in a manufacturing apparatus the toner fusing easily occurs. Moreover, in the toner manufacturing by a polymerizing method, during the granulation the coalescence of toner particles easily occurs, and an extensive particle size distribution is easily generated.

As a toner manufacturing method usable in the embodiment, the molding lubricant composed of the resin or the low softening point material, colorant, charge control agent, or the like is uniformly dispersed using a pressure kneader, extruder or media dispersing machine, then allowed to collide against a target mechanically or under a jet air current, and finely crushed to desired toner particle diameters (if necessary, processes of making smooth and spherical the toner particles can be added). Thereafter, through a classification process the particle size distribution is sharpened, to obtain the toner. In addition to the crushing method, there are a method (a fusion spraying method) described in Japanese Patent Publication No. 56-13945 in which a disc or a multi-flow nozzle is used to spray a fused mixture in air and obtain a spherical toner; a method described in Japanese Patent Publication No. 36-10231 and Japanese Patent Application Laid-Open Nos. 59-53856 and 59-61842 in which a suspending polymerizing method is used to directly generate a toner; a dispersion polymerizing method in which an aqueous organic solvent with a monomer being soluble and a polymer being unnecessary is used to directly generate a toner; an emulsion polymerizing method represented by a soapfree polymerizing method in which direct polymerization is performed under the presence of water-soluble polarity polymerization initiator to generate a toner; and the like.

Among these, in the crushing method, it is difficult to keep the toner shape coefficient SF1 measured with Lusex in the predetermined range of 100 to 150, and in the fusing spraying method, although SF1 can be kept in the predetermined range, the particle size distribution of the obtained toner tends to be widened. On the other hand, in the dispersion polymerizing method, the obtained toner indicates an extremely sharp particle size distribution, but a selection range of materials for use is narrow, and treatments of waste solvent of the used organic solvent and measures to prevent the solvent from catching fire are applied. From this and other viewpoints, there is a problem that the manufacturing apparatus tends to be complicated and complex. In the emulsion polymerizing method represented by the soapfree polymerizing method, the toner particle size distribution is relatively sharply completed, and the method is effective, but the used emulsifier and polymerization initiator terminals may be present on the toner particle surfaces, which easily deteriorates a toner environmental property.

Therefore, in the embodiment, as the toner manufacturing method, preferably, the suspending polymerizing method under a normal pressure or under a pressure. By the suspending polymerizing method, the fine particle toner having an average particle diameter of 4 to 8 $\mu$m can relatively easily be obtained with a sharp particle size distribution, and the toner shape coefficient SF1 can also be adjusted in the range of 100 to 150. Furthermore, in the present invention, a seed polymerizing method is also preferably used in which after a monomer is overlapped and adsorbed on polymer particles once obtained by polymerizing a monomer, the polymerization initiator is used to polymerize the monomer.

For the toner which can preferably be used in the embodiment, as described above, the shape coefficient SF1 measured with Lusex is in the range of 100 to 150, more preferably 100 to 125, further preferably 100 to 110, and the toner contains 1 to 30 wt % of the low softening point material. For the toner, preferably, in a fault plane measuring method of toner particles using a transmission electronic microscope (TEM), the low softening point material has a core shell structure included in an outer shell (outer shell resin layer) by the binder resin. The toner of this structure can directly be manufactured by the suspending polymerizing method.

To obtain an excellent fixing property, the toner may contain a large amount of low softening point material, and for this purpose, as described above, the low softening point material may be included in the outer shell resin. A toner in which the low softening point material is not included in the outer shell resin cannot sufficiently be finely crushed unless a special freezing crushing is performed in the crushing process, only a broad particle size distribution can be obtained, and the toner fusing to the manufacturing apparatus is unfavorably caused. Since the freezing crushing requires condensation preventive measures of the apparatus, the manufacturing apparatus is complicated. Additionally, when the toner absorbs moisture, operation properties are deteriorated, and a drying process also needs to be added.

To include the low softening point material into the toner, the polarity of the material in the aqueous solvent is set to be small in the low softening point material rather than in the main monomer, a small amount of resin or monomer large in polarity is further added, and polymerizing reaction is performed, so that the toner including the low softening point material coated with the outer shell resin is obtained.

Control of the particle size distribution of the toner and control of the particle diameter are achieved by a method of changing types or adding amounts of a dispersant having an inorganic salt hardly soluble in water and a protective colloid action, or by controlling mechanical apparatus conditions (for example, rotor peripheral speed, pass times, agitating blade shape and other agitation conditions and container conditions), concentration of a solid content in the aqueous solution, and the like.

In the embodiment, as the binder resin of the toner, a generally used styrene(metha)acryl copolymer, polyester resin, epoxy resin, or styrene-butadiene copolymer can be used. In the method in which the toner is directly obtained by the polymerizing method, the monomer is preferably used.

Preferable examples of the monomer for the binder resin include styrene; styrene monomers such as o-, m- and p-methylstyrenes, and m- and p-ethylstyrenes;

(meth)acrylic ester monomers such as methyl (meth) acrylate, ethyl(meth)acrylate, propyl (meth)acrylate, butyl (meth)acrylate, octyl (meth)acrylate, dodecyl(meth)acrylate, stearyl (meth)acrylate, behenyl(meth)acrylate, 2-ethylhexyl (meth)acrylate, dimethylaminoethyl(meth)acrylate and diethylaminoethyl(meth)acrylate; and vinyl monomers such as butadiene, isoprene, cyclohexene, (meth)acrylonitrile and acrylic amide.

These monomers may be used alone, or may in general appropriately be blended with a monomer which is described in "Polymer Handbook" (No. 2 III, pp. 139 to 192, published by John Wiley & Sons, Ltd.) and whose theoretical glass transition temperature (Tg) is in the range of 40 to 75° C. When the theoretical glass transition temperature (Tg) is less than 40° C., the storage stability or durability stability of the toner is easily lowered. On the other hand, when the temperature exceeds 75° C., a fixing point of the toner is raised. Particularly in the case of the full-color image formation, the color toners are insufficiently mixed, color reproducibility is impaired, and OHP image transparency is further unfavorably deteriorated.

In the embodiment, for the molecular weight of the binder resin, number-average molecular weight Mn is in the range of 5,000 to 1,000,000, and ratio Mw/Mn of weight-average molecular weight Mw and number-average molecular weight Mn is preferably in the range of 2 to 100. The molecular weight of the binder resin can be measured by gel permeation chromatography (GPC).

For the toner having the core shell structure, a sample for measuring the molecular weight is prepared as follows:

The toner is extracted using Soxhlet extractor with toluene solvent for 20 hours, toluene is removed with a rotary evaporator to obtain an extract, an organic solvent (for example, chloroform, or the like) which can dissolve the low softening point material but cannot dissolve the outer shell resin is further added to the extracted material, and sufficient cleaning is performed. Subsequently, a residue is dissolved with tetrahydrofuran (THF), THF solution with the residue dissolved therein is filtered with a membrane filter which has a pore diameter of 0.3 $\mu$m and has a resistance to organic solvents, and a filtered THF solution is used as the measurement sample.

For the THF solution, the molecular weight of the binder resin is measured using a chromatography apparatus 150C manufactured by Waters Co. in a column constitution in which columns A-801, 802, 803, 804, 805, 806, and 807 manufactured by Showa Denko K.K. are interconnected, by a calibration curve of standard polystyrene resin.

To stably include the low softening point material in the toner, a polarity resin is preferably added to the binder resin for use in the outer shell resin layer. As the polarity resin to be used for this purpose, a copolymer of styrene and (metha)acrylic acid, maleic acid copolymer, unsaturated polyester resin, saturated polyester resin, and epoxy resin are preferable. Among these polarity resins, particularly preferable is the resin containing in molecules no unsaturated group which can react to the vinyl monomer and another binder resin. When the polarity resin having the unsaturated group in the outer shell resin layer is contained, crosslinking reaction with the vinyl monomer of the outer shell resin layer occurs, and extremely high molecules are obtained for the full-color toner, which is disadvantageous for the mixing of four-color toners.

As colorants of the toner, a yellow colorant, magenta colorant and cyan colorant described later can be used. As a black colorant, carbon black, or a magnetic material can be used, or the colorant toned to obtain black color from the three-color colorants of yellow, magenta and cyan may be used.

As the yellow colorant, compounds represented by a condensed azo compound, an isoindolinone compound, an anthraquinone compound, an azo metal complex, a methyn compound, and an arylamide compound are used.

Specifically, C.I. pigment yellow 12, 13, 14, 15, 17, 62, 74, 83, 93, 95, 109, 110, 111, 128, 129, 147, 168, 180 are preferably used.

As the magenta colorant, a condensed azo compound, a diketopyrolopyrrole compound, an anthraquinone compound, a quinacridone compound, a basic dye lake compound, a naphthol compound, a benzimidazoline compound, a thioindigo compound, and a perylene compound are used. Specifically, C.I. pigment red 2, 3, 5, 6, 7, 23, 48:2, 48:3, 48:4, 57:1, 81:1, 144, 146, 166, 169, 177, 184, 185, 202, 206, 221, 254 are particularly preferable.

As the cyan colorant, a copper phthalocyanine compound and a derivative of the compound, an anthraquinone compound, a basic dye lake compound, and the like are used. Specifically, C.I. pigment blue 1, 7, 15, 15:1, 15:2, 15:3, 15:4, 60, 62, 66 can particularly preferably be used.

These colorants can be used alone or mixed for use, and can further be used in solid solution states.

The colorant is appropriately selected from respects of tint, chroma, brightness, resistance to weather, OHP transparency, and dispersion properties into the toner.

The adding amount of the colorant is preferably in the range of 1 to 20 parts by weight relative to 100 parts by weight of resin. When the magnetic material is used as the black colorant, different from the other colorants, the adding amount is preferably in the range of 40 to 150 parts by weight relative to 100 parts by weight of the resin.

The toner can be blended with a known charge control agent. The charge control agent is preferably colorless, fast in toner charging speed, and can stably maintain a constant charge amount. Furthermore, when the toner is manufactured by a direct polymerizing method, the charge control agent particularly preferably causes no polymerizing inhibition, and is not dissolved into the aqueous medium.

To concretely describe examples of the charge control agent, examples of a negative charge control agent include salicylic acid, alkyl salicylic acid, dialkyl salicylic acid, naphthoic acid, dicarbonic acid and another metal compound, a high-molecular compound having sulfonic acid or carbonic acid in a side chain, a boron compound, an urea compound, a silicon compound, kalliks arene, and the like. Examples of a positive charge control agent include fourth-class ammonium salt, a high-molecular compound having the fourth-class ammonium salt in a side chain, a guanidine compound, an imidazole compound, and the like.

The adding amount of the charge control agent is preferably in the range of 0.5 to 10 parts by weight relative to 100 parts by weight of resin. However, the adding of the charge control agent to the toner is not essential. For example, in the two-component developing method, the triboelectric charge of the toner with a carrier is used, and in the non-magnetic monocomponent blade coating developing method, the triboelectric charge of the toner with the developing blade or the developing sleeve is positively used. In this case, the adding of the charge control agent into the toner is not necessarily required.

When the toner is manufactured in the direct polymerizing method, as the polymerization initiator, for example, 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile and another azo or diazo polymerization initiator; and benzoyl peroxide, methyl ethyl ketone peroxide, di-isopropyl peroxycarbonate, cumene hydroperoxide, 2,4-dichchlorobenzoyl peroxide, lauroyl peroxide and another peroxidic polymerization initiator are used.

These polymerization initiators slightly differ with the polymerizing method, but referring to ten-hour half-life temperature, one type or a plurality of types are selected, and the initiators are used alone or as a mixture. The adding amount of the polymerization initiator changes in accordance with a targeted polymerization degree, but is usually in the range of 0.5 to 20 wt % relative to the monomer. To control the polymerization degree, known crosslinker, chain transfer agent, polymerization inhibitor, or the like can further be added.

When the toner is manufactured by the suspending polymerizing method using a dispersion stabilizer, the dispersion stabilizer of an inorganic compound or an organic compound can be used.

Examples of the dispersion stabilizer of the inorganic compound include tribasic calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, and the like. Examples of the dispersion stabilizer of the organic compound include polyvinyl alcohol, gelatin, methyl cellulose, methyl hydroxypropyl cellulose, ethyl cellulose, a sodium salt of carboxymethyl cellulose, polyacrylic acid and a salt thereof, starch, and the like. The dispersion stabilizer is preferably used at the ratio of 0.2 to 20 wt % relative to 100 parts by weight of the monomer.

When the dispersion stabilizer of the inorganic compound is used, a marketed product may be used as it is, but to obtain fine particles, fine particles of the inorganic compound may be generated in a dispersion medium. For example, sodium phosphate aqueous solution and calcium chloride aqueous solution are mixed in the dispersion medium under high agitating conditions to generate tribasic calcium phosphate, so that fine particles of the tribasic calcium phosphate are obtained.

In order to finely disperse the dispersion stabilizer in the dispersion medium, 0.001 to 0.1 parts by weight of surfactant can be used. For example, dodecyl benzene sodium sulfate, tetradecyl sodium sulfate, pentadecyl sodium sulfate, octyl sodium sulfate, sodium oleate, sodium laurate, potassium stearate, calcium oleate, and the like are exemplified.

By using the spherical toner of the embodiment, the transfer efficiency is improved. When the spherical toner is used, to stably maintain a predetermined triboelectric charge amount, an external application agent is added.

As the external application agent, silica, carbon black; aluminum oxide, titanium oxide, magnesium oxide, zinc oxide and another metal oxide; calcium sulfate, barium sulfate, calcium carbonate and another metal salt; calcium stearate and another aliphatic metal salt; and the like are used. An adding amount of the external application agent is in the range of 0.01 to 10 parts by weight per 100 parts by weight of the toner.

The embodiment will further be described. The present inventors manufactured a plurality of types of non-magnetic toners by changing the particle diameter by the above-described suspending polymerizing method. Moreover, the coating layer 9*b* on the surface of the developing sleeve 9 of the developing apparatus 4 of FIG. 2 was formed by varying the average particle diameter, and the like of the spherical particles 9*c* added to the layer. A plurality of developing sleeves 9 were manufactured by way of trial, a plurality of types of toners were used in the developing apparatus 4 for development, and a durability test of continuous image formation was conducted. For comparison, another developing sleeve was prepared by forming the coating layer without adding any spherical particle thereto, and the same test was conducted.

The manufactured non-magnetic toners have three types of weight-average particle diameters r of 5.1 μm, 6.1 μm, and 7.8 μm.

For the coating layer, as the binder resin, the above-described methyl methacrylate-dimethyl aminoethylmethacrylate copolymer (mol ratio of 90:10) was used. To 100 parts by weight of the copolymer, 2.5 parts by weight of carbon black as conductive particles and 22.5 parts by weight of graphite with an average particle diameter of 3 μm as lubricant were added.

Furthermore, as the spherical particles one type was selected from spherical carbon particles of volume-average particle diameters R of 3.05 μm, 5.1 μm, 11.6 μm and PMMA spherical particles of 8.4 μm, 13.1 μm, and added. By changing the adding amount in the range of 2.5 parts by weight to 20 parts by weight, different types were obtained.

To form the coating layer, a part of the above-described binder resin (methyl methacrylate-dimethylaminoethyl methacrylate copolymer) was dissolved in toluene. Then, remaining binder resin, conductive particles (carbon black and graphite), and spherical particles (carbon particles or PMMA particles) were added, further glass beads were added, and dispersion was performed by sand mill, so that the coating liquid of the coating layer was prepared. The liquid was applied to the surface of the developing sleeve 9.

Measurement of the spherical particles was performed using Coulter LS130 particle size distribution meter (manufactured by Coulter K.K.) which is a laser diffraction type particle size distribution meter, and the volume-average particle diameter was obtained from volume distribution of the obtained spherical particles. As a solvent for the measurement, isopropyl alcohol was used, 2 to 20 mg of spherical particles were added to 100 to 150 ml of the solvent, dispersing treatment was performed with an ultrasonic dispersing unit for about one to three minutes, and a measurement sample was obtained. A refractive index was 1.375, and as an optical model, a real number part of 1.5 and an imaginary number part of 0.3 were used.

Moreover, a center-line-average roughness Ra (μm) of the surface of the developing sleeve 9 was measured. For the measurement, surfcoder SE-3400 manufactured by Kosaka Laboratory Ltd. was used. Based on the surface roughness defined in JIS B0601, the measurement was performed at two upper places in a peripheral direction in each of three upper places in an axial direction of the developing sleeve, that is, at six places in total, and the average was taken.

On the photosensitive drum 1 of FIG. 1 an electrostatic latent image was formed with a non-exposed portion surface potential of −700V, and an exposed portion surface potential of −100 V. During developing operation of the developing apparatus 4, as a developing bias, a frequency of 2000 Hz, and a voltage with a direct-current voltage of −300V superimposed to an alternating-current voltage with a peak-peak voltage of 1600V were applied to the developing sleeve 9 from the power supply (not shown).

The toner was stuck to the exposed portion of the photosensitive drum 1, and the latent image was reversed out.

Images were continuously formed on 5000 sheets of A4 size, and durability test was conducted. For environment of the image formation, a low-temperature and low-humidity environment (L/L environment) of 15° C., 10% and a high-temperature and high-humidity environment (H/H environment) of 32.5° C., 85%, that is, two environments were tested. Results are shown in Table 1.

In Table 1, for density, results in the L/L environment where toner charge-up is strict and the density tends to be deteriorated are shown, and for fogging, results in the H/H environment where the triboelectric charge power of the toner itself is low and the fogging tends to be deteriorated are shown. Moreover, for the uneven vertical line, since both environments are in the same degree, results in both environments are shown.

This is because developing sleeve surface roughness Ra was 0.61 μm and excessively small, toner conveying property was excessively lowered, and a necessary amount of toner could not be held or carried on the developing sleeve. Moreover, when the toner adhering to the developing sleeve surface after completion of the durability test was removed by air spraying, on the developing sleeve surface, a white powder layer, that is, silica of the external application agent was found to adhere to a lower layer of the blown off toner layer, and a slight toner fusing was also found.

On the other hand, the coating layer with the spherical particles added thereto indicated substantially good results, but influential factors to be noted are found to be present.

TABLE 1

| | Spherical particle | | | Developing sleeve | Toner weight-average particle diameter r, image evaluation result r = 5.1 μm | | | | |
|---|---|---|---|---|---|---|---|---|---|
| | Type | Volume-average particle diameter R (μm) | Adding amount (parts by weight) | surface roughness Ra (μm) | R/r | Density Initial | Density Durable | Uneven vertical line | Fogging |
| A | nil | | 0 | 0.61 | — | x | x | ○ | ○ |
| B | Carbon particle | 3.05 | 2.5 | 0.63 | 0.60 | x | ○ | ○ | ○ |
| C | Carbon particle | 3.05 | 5.0 | 0.65 | 0.60 | ○Δ | ○ | ○ | ○ |
| D | Carbon particle | 5.1 | 2.5 | 0.65 | 1.00 | ○ | ○ | ○ | ○ |
| E | Carbon particle | 5.1 | 7.5 | 0.95 | 1.00 | ○ | ○ | ○ | ○ |
| F | Carbon particle | 5.1 | 12.5 | 1.12 | 1.00 | ○ | ○ | ○ | ○ |
| G | Carbon particle | 5.1 | 17.5 | 1.30 | 1.00 | ○ | ○ | ○ | ○Δ |
| H | Carbon particle | 5.1 | 20.0 | 1.35 | 1.00 | ○ | ○ | ○ | x |
| I | PMMA particle | 8.4 | 2.5 | 0.75 | 1.65 | ○ | ○ | ○ | ○ |
| J | PMMA particle | 8.4 | 5.0 | 0.93 | 1.65 | ○ | ○ | ○ | ○ |
| K | Carbon particle | 11.6 | 2.5 | 0.80 | 2.12 | ○ | ○ | x | ○ |
| L | Carbon particle | 11.6 | 5.0 | 1.05 | 2.12 | ○ | ○ | x | ○ |
| M | Carbon particle | 11.6 | 7.5 | 1.29 | 2.12 | ○ | ○ | x | ○ |
| N | Carbon particle | 11.6 | 10.0 | 1.38 | 2.12 | ○ | ○ | x | x |
| O | PMMA particle | 13.1 | 2.5 | 1.05 | 2.57 | ○ | ○ | x | ○ |
| P | PMMA particle | 13.1 | 5.0 | 1.22 | 2.57 | ○ | ○ | x | ○ |

| | Toner weight-average particle diameter r, image evaluation result | | | | | | | | | |
|---|---|---|---|---|---|---|---|---|---|---|
| | r = 6.1 μm | | | | | r = 7.8 μm | | | | |
| | R/r | Density Initial | Density Durable | Uneven vertical line | Fogging | R/r | Density Initial | Density Durable | Uneven vertical line | Fogging |
| A | — | x | x | ○ | ○ | —ΔA | x | ○ | ○ | |
| B | 0.50 | Δ | Δ | ○ | ○ | 0.39 | Δ | x | ○ | ○ |
| C | 0.50 | ○Δ | ○Δ | ○ | ○ | 0.39 | ○ | x | ○ | |
| D | 0.84 | ○ | ○ | ○ | ○ | 0.65 | ○ | ○Δ | ○ | ○ |
| E | 0.84 | ○ | ○ | ○ | ○ | 0.65 | ○ | ○ | ○ | ○ |
| F | 0.84 | ○ | ○ | ○ | ○ | 0.65 | ○ | ○ | ○ | ○ |
| G | 0.84 | ○ | ○ | ○ | ○Δ | 0.65 | ○ | ○ | ○ | ○Δ |
| H | 0.84 | ○ | ○ | ○ | Δ | 0.65 | ○ | ○ | ○ | x |
| I | 1.38 | ○ | ○ | ○ | ○ | 1.08 | ○ | ○ | ○ | ○ |
| J | 1.38 | ○ | ○ | ○ | ○ | 1.08 | ○ | ○ | ○ | ○ |
| K | 1.9 | ○ | ○ | ○ | ○ | 1.38 | ○ | ○ | ○ | ○ |
| L | 1.9 | ○ | ○ | ○ | ○ | 1.38 | ○ | ○ | ○ | ○ |
| M | 1.9 | ○ | ○ | ○ | ○Δ | 1.38 | ○ | ○ | ○ | ○ |
| N | 1.9 | ○ | ○ | ○ | x | 1.38 | ○ | ○ | ○ | x |
| O | 2.15 | ○ | ○ | x | ○ | 1.68 | ○ | ○ | ○ | ○ |
| P | 2.15 | ○ | ○ | x | ○ | 1.68 | ○ | ○ | ○ | ○ |

○: better Δ: middle x: worse

In Table 1, A is a comparative example in which the spherical particles are not added to the coating layer of the developing sleeve surface. In the comparative example, there was no problem about the uneven vertical line or fogging of the image, but for the image density, both initial density and latter-period density after 5000 sheets were reached became insufficient regardless of toner diameters.

First, when the initial density is noted, it is found to be correlated with the surface roughness Ra.

Specifically, a comparison of cases B and C of Table 1 in which the spherical carbon particles of the same particle diameter are added shows that in the case B having Ra of 0.63 μm, as the toner particle diameter increases, the initial density tends to be slightly nehanced, but is insufficient. On the other hand, in C in which Ra is 0.65 μm, the initial density is satisfied regardless of the toner particle diameters. Also in D and subsequent cases of the table, the initial density is satisfactory. Specifically, to satisfy the initial density, the developing sleeve surface roughness Ra needs to be set to 0.65 pm or more.

Subsequently, referring to the durable density, from results of B, C, D of the table, the durable density is deteriorated when toner particle diameter r is large, and particle diameter R of the spherical particle added to the coating layer is small. When ratio R/r of these diameters is small, the durable density is deteriorated. To satisfy the durable density, the ratio R/r needs to be 0.5 or more.

To check causes for the deterioration of the durable density, the toners adhering to the developing sleeve surfaces of B, C, D after the completion of the durability test were removed by air spraying. It was then found that on the developing sleeve surfaces of B, C, D, more white powder layers of the external application agent silica adhered to the lower layers of the blown off toner layers when the durable density was lower. Furthermore, a slight toner fusing was also found. Specifically, it has been found that the low density by the durability test is caused by the contamination of the developing sleeve surface, and the particle diameter R of the spherical particle needs to be increased in accordance with the toner particle diameter r. Therefore, as described above, R/r needs to be 0.5 or more.

Subsequently, referring to the uneven vertical line, image unevenness is deteriorated when the particle diameter R of the spherical particle added to the coating layer is large, and the toner particle diameter r is small, and there is a correlation with R/r. Referring to K to P in the table, when R/r exceeds 2, the uneven vertical lines are generated, and when the ratio is 1.9 or less, the image without any uneven vertical line is obtained.

As a result of checking of causes, the surface of the polyamide elastomer layer 10*b* of the developing blade 10 is linearly shaved by the spherical particles in the coating layer on the surface of the developing sleeve 9, when the blade slides against the developing sleeve 9 at the nip portion. Since the toner regulated by the developing blade 10 is passed through linear shaved portions, the uneven vertical lines are generated on the image. The linear shaved portions are enlarged when the particle diameter of the spherical particle is large, and through the same shaved portion he toner particle having a smaller particle diameter s more easily passed. Therefore, as described above, y setting the ratio of the spherical particle diameter R and toner particle diameter r to 1.9 or less, the generation of the uneven vertical lines of the image can probably be prevented.

Finally, referring to the fogging, the fogging is not related with the toner particle diameter or the spherical particle diameter, and is influenced only by the surface roughness Ra of the developing sleeve 9. When Ra exceeds 1.3 μm, the coating amount of the toner on the developing sleeve 9 becomes excessive, and the fogging is deteriorated.

From the above, with regard to the influential factors of the center-line-average roughness Ra (μm) of the surface of the developing sleeve 9 with the coating layer containing the spherical particles formed thereon, the toner average particle diameter r (pm), and the spherical particle volume-average particle diameter R (μm), the following relationship is defined:

$$0.65 \leqq Ra \leqq 1.3 \text{ and } 0.5 \leqq R/r \leqq 1.9,$$

whereby the wear resistance of the developing sleeve 9 is enhanced, the appropriate toner feeding properties are secured, and the effective application of the triboelectric charge to the toner can stably be performed.

As described above, in the present embodiment, when the polymerized toner or another non-magnetic toner having the shape coefficient SF1 of 100 to 150, having the substantially spherical shape, and containing 5 to 30 wt % of the low softening point material is used in the developing apparatus, on the developing sleeve surface the coating layer is formed by the resin containing the spherical particles, so that the wear resistance of the developing sleeve is enhanced. Furthermore, the surface roughness of the developing sleeve and the relationship of spherical particle diameter and toner particle diameter, which are important influential factors in the formation of the toner thin layer on the developing sleeve, are defined. Therefore, the appropriate toner conveying property and the applying property of the triboelectric charge to the toner are stably fulfilled by the developing sleeve, and on the developing sleeve an excellent toner thin layer can be formed and used for development.

What is claimed is:

1. A developing apparatus comprising:

a developer container for containing a developer;

a developer bearing member for bearing the developer contained in said developer container, said developer bearing member having a surface layer containing substantially spherical particles, wherein a relation between a weight-average particle diameter r (μm) of a toner in said developer and a volume-average particle diameter R (μm) of said spherical particles satisfies an expression $0.5 \leqq R/r \leqq 1.9$.

2. The developing apparatus according to claim 1, further comprising a regulating member for regulating a layer thickness of the developer borne by said developer bearing member.

3. The developing apparatus according to claim 1, wherein a center-line-average roughness Ra (μm) on the surface of said developer bearing member satisfies $0.65 \leqq Ra \leqq 1.3$.

4. The developing apparatus according to claim 1, further comprising a developer supplying member for supplying the developer to said developer bearing member.

5. The developing apparatus according to claim 1, herein said toner contains 5 to 30 wt % of a low softening point material.

6. The developing apparatus according to claim 1, wherein a shape coefficient SF1 of said toner is in the range of 100 to 150.

7. The developing apparatus according to claim 1, wherein said surface layer contains a conductive powder.

8. The developing apparatus according to claim 1, wherein said surface layer contains a solid lubricant.

9. The developing apparatus according to claim 1, wherein said surface layer is formed of a resin containing the spherical particles, and the resin is a copolymer of a methyl methacrylate monomer and a nitrogen-containing vinyl monomer.

10. The developing apparatus according to claim 1, wherein said toner is a non-magnetic toner manufactured by a polymerizing method.

11. The developing apparatus according to claim 2, wherein said regulating member comprises a plate member having elasticity, and a polyamide-containing elastomer layer formed on the plate member by adhesion molding.

12. The developing apparatus according to claim 2, wherein said regulating member abuts against the surface layer of said developer bearing member.

13. The developing apparatus according to claim 1, wherein an alternate voltage is applied to said developer bearing member.

14. A developing apparatus comprising:

a developer container for containing a developer;

a developer bearing member for bearing the developer, said developer bearing member having a surface layer containing substantially spherical particles;

a developer supplying member for supplying the developer to said developer bearing member; and a regulating member for regulating a layer thickness of the developer borne by said developer bearing member, said regulating member abutting against the surface layer of said developer bearing member, wherein a center-line-average roughness Ra ($\mu$m) on the surface of said developer bearing member, and a relation between a weight-average particle diameter r ($\mu$m) of a toner in said developer and a volume-average particle diameter R ($\mu$m) of said spherical particles satisfy expressions $0.65 \leqq Ra \leqq 1.3$ and $0.5 \leqq R/r \leqq 1.9$, respectively.

* * * * *

UNITED STATES PATENT AND TRADEMARK OFFICE

CERTIFICATE OF CORRECTION

PATENT NO. : 6,115,575

DATED : September 5, 2000

INVENTOR(S) : Masahide KINOSHITA et al.

It is certified that error appears in the above-identified patent and that said Letters Patent is hereby corrected as shown below:

COLUMN 10

Line 65, "C." should read --C.,--;

COLUMN 11

Line 41, "4 μto" should read --4 to--.

COLUMN 17

Line 1, "¶benzoyl" should read --benzoyl--.
Line 3, "¶dichchlorobenzoyl" should read --dichlorobenzoyl--.

COLUMN 18

Line 9, "¶Furthermore," should read --Furthermore,--.

COLUMN 20

"Table 1" should read --Attached--; and
Line 67, "nehanced," should read --enhanced,--.

COLUMN 21

Line 48, "s" should read --is--; and
Line 49, "y" should read --by--.

UNITED STATES PATENT AND TRADEMARK OFFICE

CERTIFICATE OF CORRECTION

PATENT NO. : 6,115,575

DATED : September 5, 2000

INVENTOR(S) : Masahide KINOSHITA et al.

It is certified that error appears in the above-identified patent and that said Letters Patent is hereby corrected as shown below:

COLUMN 22

Line 67, "adhesion molding" should read --adhesion or molding--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*